United States Patent [19]

Craig

[11] Patent Number: 4,607,396

[45] Date of Patent: Aug. 26, 1986

[54] COVERALL GARMENT WITH CONCEALED SEAT PANEL

[76] Inventor: Bonnie Craig, 2141 N. Cahuenga, Apt. #8, Los Angeles, Calif. 90068

[21] Appl. No.: 631,608

[22] Filed: Jul. 17, 1984

[51] Int. Cl.[4] ..... A41D 1/06; A41D 27/20

[52] U.S. Cl. ..... 2/79; 2/247

[58] Field of Search ..... 2/79, 78 B, 78 R, 114, 2/80, 247

[56] References Cited

U.S. PATENT DOCUMENTS

| | | | |
|---|---|---|---|
| 2,252,885 | 8/1941 | Fellroth | 2/79 |
| 2,849,717 | 9/1958 | Klotz | 2/79 |
| 3,956,774 | 5/1976 | Spaulding | 2/79 |
| 3,994,026 | 11/1976 | Sampey | 2/79 |
| 4,457,025 | 7/1984 | Meryash | 2/79 |

*Primary Examiner*—H. Hampton Hunter
*Attorney, Agent, or Firm*—David O'Reilly

[57] ABSTRACT

A coverall type garment comprised of integrally formed upper blouse or shirt portion and a lower pants portion. The pants portion has an integrally formed panel to permit a person wearing the garment to comfortably use restroom facilities. The panel is uniquely formed to be completely concealed and also as a fashion feature when the garment is being worn. The concealment is accomplished by forming the panel as a part of the waistband and belt and side pockets. The rear seam of the opening of the opening entrance to the side pockets also forms a seam for the panel so that seams for the panel are completely concealed. The flaps of the material forming the pocket also are constructed to unfold when the panel is released providing a wide opening.

4 Claims, 4 Drawing Figures

COVERALL GARMENT WITH CONCEALED SEAT PANEL

FIELD OF THE INVENTION

This invention relates to clothing and more particularly, relates to one-piece coverall type garments.

BACKGROUND OF THE INVENTION

One piece type garments, particularly ladies versions have become more and more popular in recent years. In these types of garments the upper blouse portion and lower pants portion are all integrally formed with sleeves and legs as well as neck and waist portions. While they have achieved substantial popularity, a deterrent to their use has been the necessity of nearly completely removing the garment when using restroom facilities. This is particularly true for women. In many cases, women find it most undesirable when using cold unsanitary public restroom facilities. The need to completely remove the garment which when removed, may touch unsanitary surfaces such as the floor of the public restroom is particularly unsatisfactory.

It would be advantageous if a garment could be made having a panel which provided a sufficiently wide opening to permit comfortable use of restroom facilities constructed to be completely concealed in normal use.

Therefore, it is one object of the present invention to provide a one-piece coverall type garment having a completely concealed panel to permit comfortable easy use of restroom facilities.

Yet another object of the present invention is to provide a one piece coverall garment having a concealed seat panel integrally formed with a waistband to conceal the seams.

Yet another object of the present invention is to provide a one piece coverall garment having a concealed seat panel integrally formed with pocket flaps.

Yet another object of the present invention is to provide a one piece coverall garment having a concealed seat panel in which the seams of the pocket opening and the panel are coincident so that the panel is concealed.

Yet another object of the present invention is to provide a one piece coverall garment having a concealed seat panel integrally formed with the pocket flaps which unfold when the panel is dropped.

BRIEF DESCRIPTION OF THE INVENTION

The purpose of the invention is to provide a one piece coverall type garment generally referred to in the garment industry as "jump suit" having a concealed panel to permit comfortable easy use of restroom facilities which does not detract from the overall aesthetic design of the garment. The design is also applied to mens coveralls and childrens clothing such as garments known as "rompers".

To accomplish the above purposes the one-piece coverall garment is constructed of an upper blouse shirt portion integrally formed with a lower pants portion having a seat panel concealing an opening to permit use of restroom facilities. The seat panel is formed with the upper edge comprised of a waistband which also is utilized to fasten or secure the panel when the garment is worn. The waistband can be in the form of a belt having ties, snaps, zippers or any other means for securing the panel around the waist. The seams along the sides of the concealed panel are formed coincident with the openings to side pockets to thereby also conceal the side seams of the panel. The pockets are formed of flaps sewn at the bottom and partially up the side leaving a portion which unfolds with the panel. This serves to permit a wide opening for allowing comfortable, easy use of restroom facilities.

The above and other objects advantages and novel features of the invention will be more fully understood from the following detailed description and the accompanying drawings, in which:

DETAILED DESCRIPTION OF THE INVENTION

Figure 1:
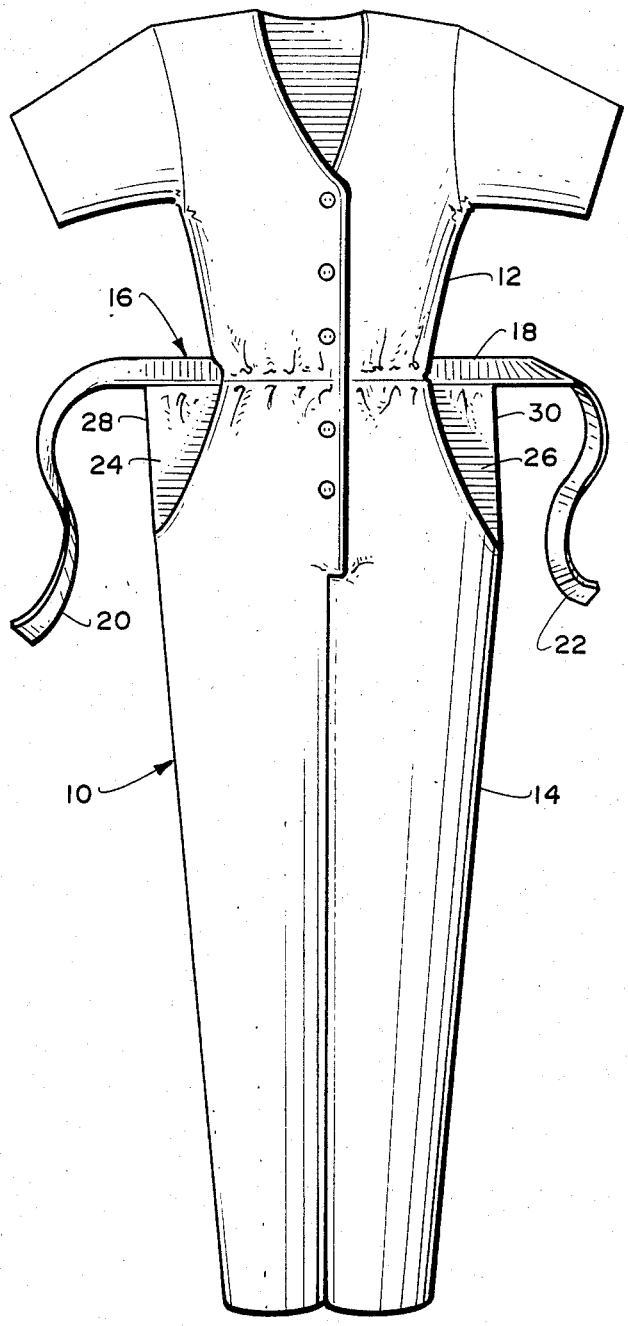
FIG. 1 is a front elevation of a one piece coverall garment illustrating the concealed panel.

A one-piece coverall garment generally referred to as a "jump-suit" is shown generally at 10 and is comprised of an upper blouse or shirt portion 12 and a lower pants portion 14. The blouse sleeves and the pant legs may be any design, short or long, as desired.

Integrally formed with the garment is a concealed panel 16 having a waistband 18 with belt loops 20 and 22 for tieing around the waist to secure the panel.

Figure 2:
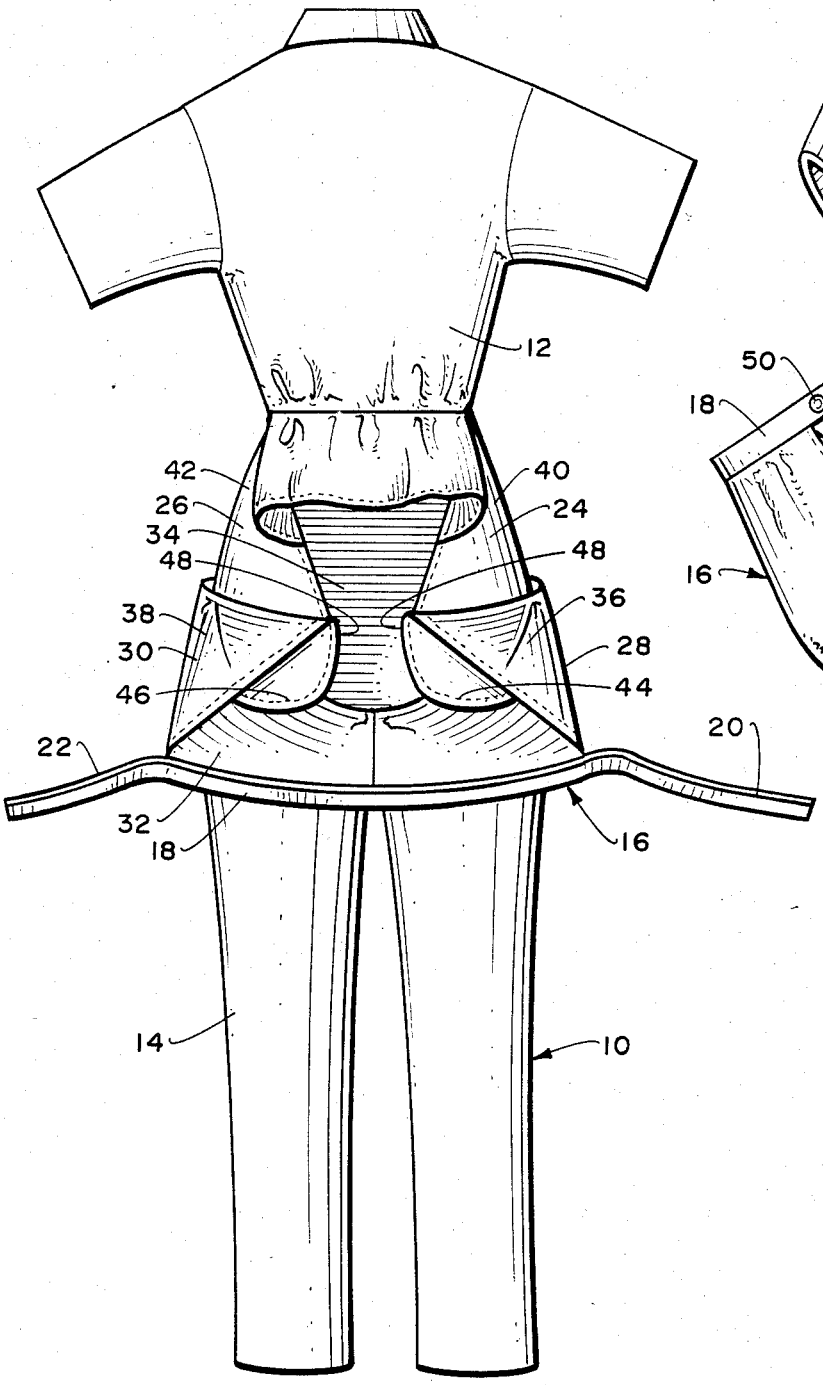
FIG. 2 is a rear view of the one-piece coverall garment of FIG. 1 with the concealed panel dropped to illustrate its use.

Side pockets 24 and 26 are formed integrally with the seat panel 16 to assist in concealing the panel. This is accomplished by securing the pockets at seams 28 and 30 to the panel so that the pocket seam and panel are coincident. This can be more clearly seen in FIG. 2 in which seat portion 32 is shown attached to the waistband 18 and to pocket flaps at 28 and 30. With the seat panel dropped as illustrated in FIG. 2 a large opening 34 is accessed permitting comfortable easy use of restroom facilities or toilets.

An additional unique feature of the invention is the formation of the side pockets 24 and 26. The side pockets are comprised of flaps 36 and 38 sewn to flaps 40 and 42 at the bottom at 44 and 46 and partially up the sides at 48. As thus constructed the pockets can unfold with the seat panel 16 providing complete access to the opening 34. With the construction as thus described, more attractive functional jump suits on other coverall garments such as mens overalls and childrens rompers, playsuits and pajamas can be designed without the disadvantages of the presently designed garments.

Figure 4:
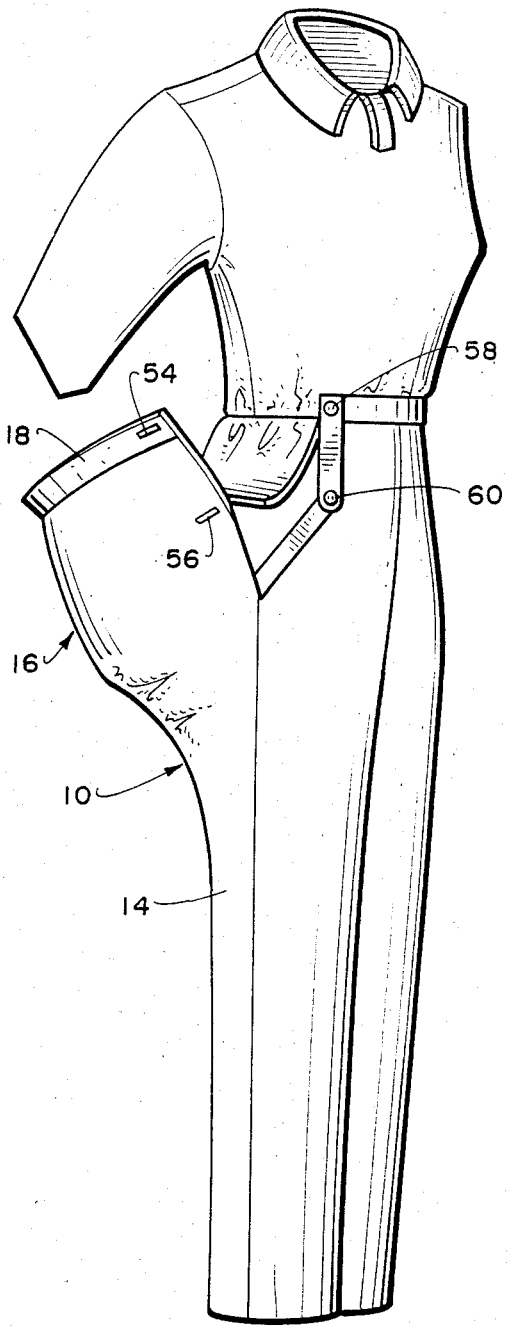
FIG. 4 is a perspective view of a further additional embodiment of the invention illustrating the construction of the concealed panel.
Figure 3:
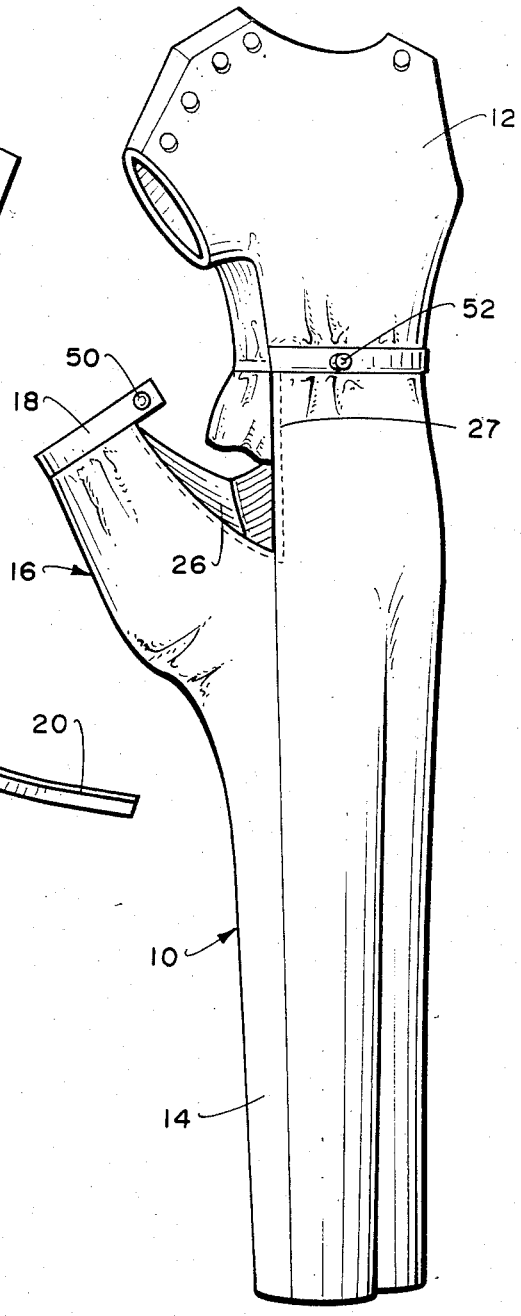
FIG. 3 is a perspective view of another embodiment illustrating a different design for the concealed panel.

Alternate designs are illustrated in FIGS. 3 and 4. In the design of FIG. 3, the seat panel 16 is formed with a waistband 18, having snaps 50 and 52 for securing the panel closed. The unfolding of the pocket 26 can be more clearly seen in this figure. As the seat panel is lowered, the joining of the seat pockets with the panel also serves to fold the pocket out of the way during use of restroom facilities.

In FIG. 4, a further alternate design is shown in which the seat panel 16 and pocket have button holes 54 and 56 which permit closure by securing with buttons 58 and 60. The design shown will permit a variety of types of back or back treatments. The back can be buttoned, back zippered, snapped, wrapped or the tied type of waistband or plain. A variety of types of front tailoring designs are also available with the construction shown. Various means can be provided to secure the waist such as elastic of various widths regular or irregular waistbands with buttons, snaps, rings, belts, zippers, Velcro or various design of closures and fasteners. Additionally, the pockets 24 and 26 can be plain, straight, seamed or angled as illustrated in FIG. 4. The pockets can be opened or closed using snaps, buttons, Velcro, zippers, etc. All of which would further enhance the concealment of the seat panel and provide a more complete closure. For example, complete closure by zippers at 27 of FIG. 3, would be desirable in ski wear and children for keeping out snow, etc. This would also be desirable in childrens wear such as in playsuits.

Thus there has been disclosed a novel, unique one-piece coverall type garment incorporating a seat panel permitting comfortable easy use of restroom facilities which does not infringe on or detract from basic design features because of the panel is incorporated and completely concealed through the construction of side pockets and the waistband.

This invention is not to be limited by the embodiments shown in the drawings and described in the description which are given by way of example and not of limitation but only in accordance with the scope of the impending claims.

What is claimed is:

1. A one-piece coverall garment having integrally formed shirt portion, pants portion and a pair of side pockets comprising;

a seat panel in said pants portion covering an opening at the rear of said pants portion;

a waistband on an upper portion of said panel for concealing said panel when said garment is being worn;

said pair of side pockets each being constructed of a front flap of material and a rear flap of material, said front flap being joined to a front portion of said pants portion, said rear flap being joined along an edge of said seat panel to form a seam; and said front and rear flaps being sewn together along a portion of one edge whereby said front and rear flaps fold together to form a pocket when said seat panel is secured with said waistband and said front and rear flaps unfold when said seat panel is released thereby providing a large comfortable opening to use while substantially completely allowing said seat panel to be concealed.

2. The article according to claim 1 in which said panel includes an integrally formed waistband thereby concealing an upper edge of said panel.

3. The article according to claim 1 in which said waistband includes means for fastening said panel closed.

4. The article according to claim 1 in which said waistband has an integrally formed belt for securing said panel in a closed position.

* * * * *